US010961000B2

(12) United States Patent
Arredondo

(10) Patent No.: US 10,961,000 B2
(45) Date of Patent: Mar. 30, 2021

(54) METHOD OF FORMING GROUPS OF SMOKING ARTICLES

(71) Applicant: British American Tobacco Mexico, S.A. DE C.V., Nuevo Leon (MX)

(72) Inventor: Lucio Arredondo, Nuevo Leon (MX)

(73) Assignee: BRITISH AMERICAN TOBACCO MEXICO, S.A. DE C.V., Nuevo Leon (MX)

( * ) Notice: Subject to any disclaimer, the term of this patent is extended or adjusted under 35 U.S.C. 154(b) by 344 days.

(21) Appl. No.: 15/764,416

(22) PCT Filed: Sep. 29, 2015

(86) PCT No.: PCT/GB2015/052823
§ 371 (c)(1),
(2) Date: Mar. 29, 2018

(87) PCT Pub. No.: WO2017/055783
PCT Pub. Date: Apr. 6, 2017

(65) Prior Publication Data

US 2018/0273220 A1 Sep. 27, 2018

(51) Int. Cl.
*A24C 5/35* (2006.01)
*B65B 19/10* (2006.01)
(Continued)

(52) U.S. Cl.
CPC ..... *B65B 19/10* (2013.01); *A24C 5/35* (2013.01); *A24D 1/02* (2013.01); *B65B 19/12* (2013.01);
(Continued)

(58) Field of Classification Search
None
See application file for complete search history.

(56) References Cited

U.S. PATENT DOCUMENTS 5,499,636 A * 3/1996 Baggett, Jr. ..... A24F 47/008 131/194
7,383,950 B1 6/2008 Roberts
(Continued)

FOREIGN PATENT DOCUMENTS

CN 202295856 U 7/2012
CN 204548959 U 8/2015
(Continued)

OTHER PUBLICATIONS

Australian Examination Report dated Oct. 12, 2018 re: Application No. 2015411093, pp. 1-10, citing: KR 100544302 B1, WO 2006016154 A2, WO 2008090071 A1, US 20110006107 A1, EP 1626003 A1, WO 2014015940 A1, CN 202295856 U and CN 204548959 U.
(Continued)

*Primary Examiner* — Katelyn B Whatley
*Assistant Examiner* — Katherine A Will
(74) *Attorney, Agent, or Firm* — Cantor Colburn LLP

(57) ABSTRACT

A method of forming groups of smoking articles so that each group forms an individual bundle of smoking articles for receipt in a respective smoking article pack is disclosed. The method includes supplying a receptacle of an apparatus for forming groups of smoking articles with different types of smoking articles such that they mix in the receptacle and each group is formed from the mixture of different types of smoking articles by said apparatus. An apparatus for forming groups of smoking articles and a multipack comprising a plurality of smoking article packs is also disclosed.

11 Claims, 4 Drawing Sheets

(51) Int. Cl.

| | |
|---|---|
| ***B65B 59/02*** | (2006.01) |
| ***B65B 59/00*** | (2006.01) |
| ***A24D 1/02*** | (2006.01) |
| ***B65B 19/12*** | (2006.01) |
| ***B65D 85/10*** | (2006.01) |

(52) U.S. Cl.
CPC ..... *B65B 59/001* (2019.05); *B65B 59/02* (2013.01); *B65D 85/10* (2013.01); *B65B 2220/14* (2013.01); *B65B 2220/16* (2013.01)

(56) References Cited

U.S. PATENT DOCUMENTS

| | | | | |
|---|---|---|---|---|
| 2005/0061828 | A1* | 3/2005 | Crogan ..... | B65B 19/04 221/265 |
| 2010/0139676 | A1 | 6/2010 | Yanchev | |
| 2011/0006107 | A1 | 1/2011 | Lutzig | |

FOREIGN PATENT DOCUMENTS

| | | | |
|---|---|---|---|
| DE | 102009021146 | A1 | 11/2010 |
| EP | 1626003 | A1 | 2/2006 |
| GB | 2188895 | A | 10/1987 |
| JP | 2003205909 | A | 7/2003 |
| JP | 2006056603 | A | 3/2006 |
| WO | 2006016154 | A2 | 2/2006 |
| WO | 2008090071 | A1 | 7/2008 |
| WO | 2014015940 | A1 | 1/2014 |

OTHER PUBLICATIONS

Demand for International Preliminary Examination for corresponding application PCT/GB2015/052823 filed Sep. 29, 2015; dated Jul. 28, 2017.

International Preliminary Report on Patentability for corresponding application PCT/GB2015/052823 filed Sep. 29, 2015; Oct. 24, 2017.

International Search Report for corresponding application PCT/GB2015/052823 filed Sep. 29, 2015; dated May 13, 2016.

Reply to Written Opinion for corresponding application PCT/GB2015/052823 filed Sep. 29, 2015; dated Sep. 29, 2017.

Written Opinion of the International Preliminary Examining Authority for corresponding application PCT/GB2015/052823 filed Sep. 29, 2015; dated Aug. 21, 2017.

Written Opinion of the International Searching Authority for corresponding application PCT/GB2015/052823 filed Sep. 29, 2015; dated May 13, 2016.

* cited by examiner

METHOD OF FORMING GROUPS OF SMOKING ARTICLES

TECHNICAL FIELD

The present invention relates to a method of forming groups of smoking articles so that each group forms an individual bundle of smoking articles for receipt in a smoking article pack. The method uses an apparatus for forming groups of smoking articles that preferably groups smoking articles into multiple rows. An apparatus for forming groups of smoking articles and, a multipack, that comprises a plurality of smoking article packs, is also disclosed.

BACKGROUND

In an apparatus for forming groups of smoking articles, a bulk supply of loose smoking articles supplied to a receptacle, such as a hopper, from a cigarette manufacturing machine are fed under gravity into a number of sets of channels. The smoking articles is pass down each channel in single file. Each set of channels supplies the smoking articles that comprise one row of a group of smoking articles, each group of smoking articles comprising multiple rows. The number of channels in a set of channels corresponds to the number of smoking articles in the row which is formed by that set of channels. An apparatus for forming groups of smoking articles of this type is primarily used to form groups of smoking articles formed in three rows prior to wrapping of each group in barrier material to form a bundle and before that bundle is received within an outer carton or container to form a conventional hinged-lid pack of smoking articles.

By way of example, apparatus for forming groups of smoking articles may have three sets of channels. A first set may have seven channels to form a first row of seven smoking articles. A second set may have six channels to form a second or centre row of six smoking articles which are laid on top of the first row, and a third row may have seven channels to form a third row of seven smoking articles, which are laid on top of the second row. The three rows comprise twenty smoking articles in total.

The smoking articles which are supplied to the receptacle of the apparatus for forming groups of smoking articles may be filter cigarettes. The filter rod of each cigarette may contain an object, such as a capsule, which has been inserted into the filter rod using a filter rod making machine.

SUMMARY

According to an embodiment of the present invention, there is provided a method of forming groups of smoking articles so that each group forms an individual bundle of smoking articles for receipt in a respective smoking article pack, wherein the method comprises supplying a receptacle of an apparatus for forming groups of smoking articles with different types of smoking articles such that they mix in the receptacle and each group is formed from the mixture of different types of smoking articles by said apparatus.

The method may comprise supplying the receptacle with a mixture of different types of smoking articles.

In one embodiment, the receptacle comprises a divider to separate the receptacle into a first section and a second section. The method may then comprise supplying different types of smoking articles to the first section and supplying smoking articles to the second section, and the apparatus may be configured so that each group formed by said apparatus includes smoking articles from both the first and second sections.

The supplying of different types of smoking article to the first section may comprise supplying them to the first section so that they mix in the first section. A mixture of different types of smoking article may also be supplied to the first section.

The method may comprise supplying the second section of the receptacle with smoking articles of only a single type.

The smoking articles that are supplied to the first and second sections may be of different types. Therefore, if the first section is supplied with two different types of smoking articles and the second section is supplied with one type of smoking article, there would be three different types of smoking article in total. However, it is also possible to supply the second section of the receptacle with one of the types of smoking articles of the different types of smoking articles supplied to the first section.

In an alternate embodiment, each of the first and second sections may be supplied with different types of smoking articles. The different types of smoking articles supplied to one section may be completely different to the different types of smoking articles supplied to the other section. Therefore, if each of the first and second sections of the receptacle is supplied with two different types of smoking articles, there would be four different types of smoking articles in total. However, one of the types of smoking articles of the different types of smoking article supplied to the first section could be the same as one of the types of smoking articles of the different types of smoking articles supplied to the second section.

The supplying of different types of smoking article to the second section may comprise supplying them to the second section so that they mix in the second section. A mixture of different types of smoking article may also be supplied to the second section.

The method may comprise positioning the divider to control the relative number of smoking articles that are supplied from each section to form each group. Preferably, the divider is positioned so that each group is formed from smoking articles from both the first and second sections of the receptacle.

The apparatus for forming groups of smoking articles may comprise a set of channels arranged so that smoking articles fed from the receptacle travel downwardly along each channel in single file, the number of channels corresponding to the number of smoking articles in a row that forms a portion of a group of smoking articles. The arrangement may be such that a line of smoking articles at a lowermost end of the channels are pushed into a pocket to form a row that comprises a portion of a group of smoking articles. The method may comprise positioning the divider so that some of the channels are fed with smoking articles from the first section and so that some of the channels are fed with smoking articles from the second section, such that the row of smoking articles comprises a mixture of smoking articles from both the first and second sections.

According to another aspect of the invention, there is provided a method of forming successive groups of smoking articles in which the successive groups formed comprise a different mixture of different types of smoking articles using apparatus for forming groups of smoking articles, the method comprising supplying a receptacle of an apparatus for forming groups of smoking articles with different types of smoking articles so that they mix in the receptacle and each group is formed from said mixture of different types of smoking articles by said apparatus.

The method may comprise supplying the receptacle with a mixture of different types of smoking articles.

According to another aspect of the invention, there is provided an apparatus for forming groups of smoking articles so that each group forms an individual bundle of smoking articles for receipt in a smoking article pack, the apparatus comprising an apparatus for forming groups of smoking articles having a receptacle and a divider to divide the receptacle into first and second sections so that each group is formed from a different type of smoking article received in each of said first and second sections, the divider being repositionable to control the relative number of smoking articles supplied to each group from each of said first and second sections.

The apparatus may comprise a set of channels arranged so that smoking articles fed from the receptacle travel downwardly along each channel in single file, the number of channels corresponding to the number of smoking articles in a row that forms a portion of a group of smoking articles. The arrangement may be such that smoking articles at a lowermost end of the channels are pushed into a pocket to form a row that makes up a portion of a group of smoking articles. The dividing element may be positionable so that some of the channels are fed with smoking articles from the first section and the remaining channels are fed with smoking articles from the second section, such that the row of smoking articles comprises a mixture of smoking articles from both the first and second sections.

The apparatus for forming groups of smoking articles may comprise a plurality of sets of channels, the number of sets of channels corresponding to the number of rows of smoking articles in a group. In this case, there may be additional dividing elements to divide more than one of the sets of channels into different sections.

According to another aspect of the invention, there is provided a multipack comprising a plurality of smoking article packs contained within an outer container, such as a film wrapper. Each of the smoking article packs may comprise a group of smoking articles formed from a mixture of at least two different types of smoking article, wherein the mixture of different types of smoking articles contained in one of the packs differs from the mixture of different types of smoking articles contained in at least one other of the packs.

Each type of smoking article may have a different respective appearance to enable smoking articles of each type to be visually distinguished from smoking articles of each of the other types. For example, each type of smoking article may have a visual and/or tactile marking to facilitate its identification by a consumer as being of a particular or corresponding type. In certain embodiments, each type of smoking article includes tipping paper. Different types of smoking articles may therefore be distinguished from each other by different tipping papers.

BRIEF DESCRIPTION OF THE DRAWINGS

In order that the invention may be more fully understood, embodiments thereof will now be described, by way of example only, with reference to the accompanying drawings, in which.

DETAILED DESCRIPTION

Figure 1:
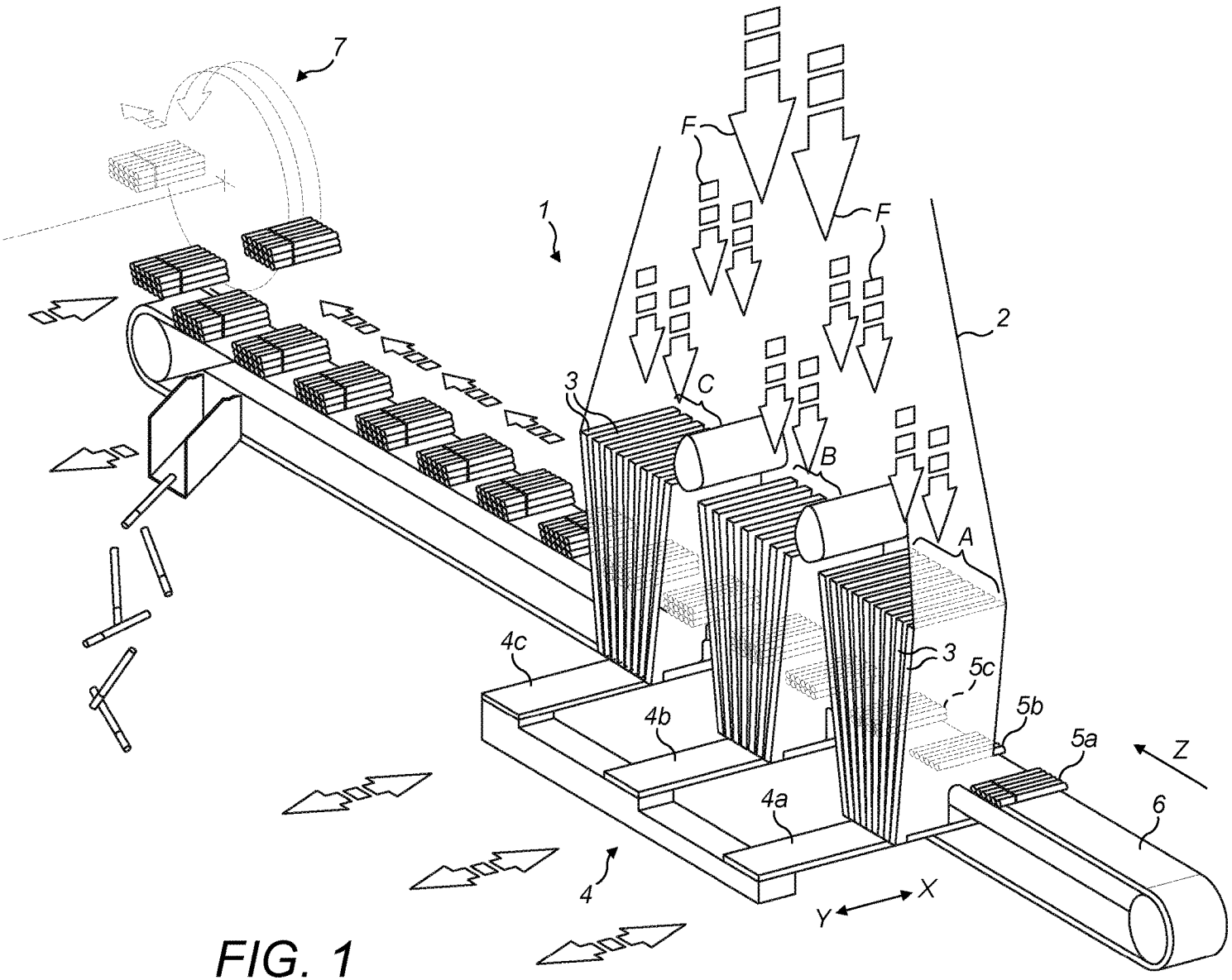
FIG. 1 is perspective view of a conventional apparatus for forming groups of smoking articles which forms groups of smoking articles in multiple rows and delivers them to a packaging machine.

A conventional apparatus for forming groups of smoking articles 1 is shown in FIG. 1 and comprises a receptacle in the form of a hopper 2 to receive a bulk supply of smoking articles (not shown in FIG. 1) that are fed into the hopper 2 from a smoking article manufacturing machine, in the direction indicated by arrows marked 'F'. The apparatus 1 forms separate groups of smoking articles, each group comprising multiple rows of smoking articles, which form a bundle for receipt in a smoking article pack in a later stage of a continuous pack assembly operation. Optionally, the bundle will include a layer of barrier material which is wrapped around each group of smoking articles prior to receipt of the bundle in a smoking article pack.

As the apparatus for forming groups of smoking articles 1 shown in FIG. 1 is known to persons skilled in the art, its construction and method of operation will only be described briefly, prior to describing a method of using the apparatus 1 according to a preferred method of the invention. Following this, apparatus form forming groups of smoking articles 1 according to an embodiment of the invention will be described.

Figure 2:
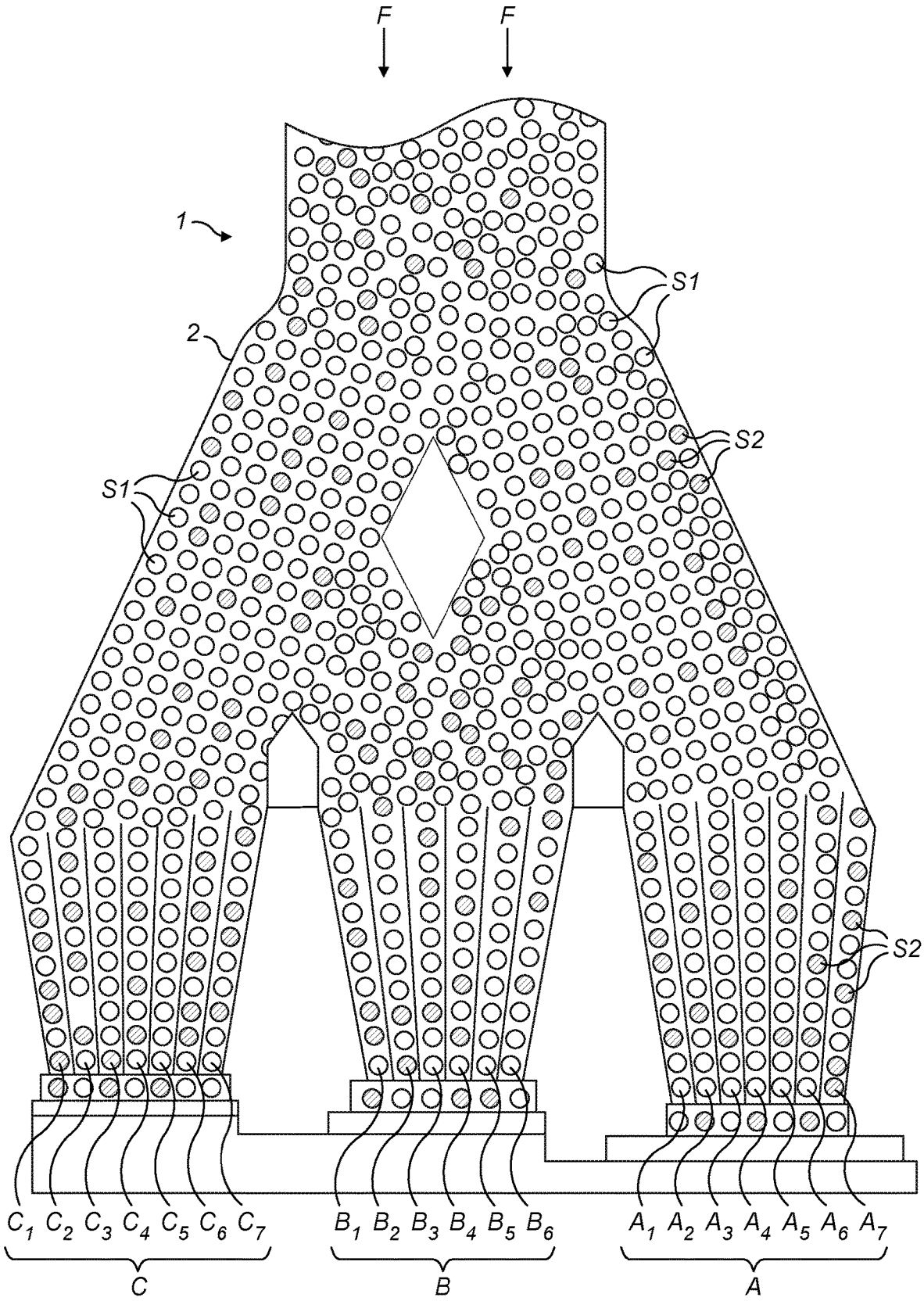
FIG. 2 is a cross-sectional side elevation of a portion of the apparatus of FIG. 1 but which has been supplied with a mixture of different types of smoking article according to the method of the invention.

The apparatus for forming groups of smoking articles 1, as shown in FIG. 1, has three sets of channels, as indicated by A, B and C, respectively. These sets of channels A, B, C are positioned so that smoking articles feed downwardly into the channels of each set A, B, C, from the hopper 2 under their own weight. The channels A1 to A7 of set A, B1 to B6 of set B and C1 to C7 of set C are formed by spaces or gaps between adjacent fixed vanes 3, as shown in FIG. 2. The spacing between adjacent vanes 3 is such that the smoking articles can only pass downwardly along each channel of each set in a single file.

The number of sets of channels A, B, C corresponds to the number of rows of smoking articles in a group. As the apparatus 1 shown in FIG. 1 has three sets of channels A, B, C, it is capable of forming a group of smoking articles having three rows, this being the most common number of rows of smoking articles in a pack. Furthermore, the number of channels in a set A, B, C corresponds to the number of smoking articles in the row that is provided by that set A, B, C. In FIG. 1, channel set A, which is a first set, provides smoking articles that make up a first row of the group and has seven channels, A1 to A7 (see FIG. 2), so that the first row of the group will comprise seven smoking articles. Channel set B, which is a second set, provides smoking articles that make up a second or middle row of the group and has six channels, B1 to B6, so that the second row will comprise six smoking articles. Channel set C, which is a third set, provides smoking articles that make up a third row of the group and has seven channels, C1 to C7, so that the third row will comprise seven smoking articles. Thus, the apparatus 1, as shown in FIG. 1, provides a group of twenty smoking articles separated into three rows with seven smoking articles in the first row, six in the second or middle row and seven in the third row. This arrangement of smoking articles is the most common smoking article grouping found in conventional smoking article packs.

A carriage 4 is located underneath each of the sets of channels A, B, C so that as the smoking articles travel downwardly along the channels, the smoking article at the bottom of each of the channels of each set will come to rest upon the surface of the carriage 4 directly beneath it. The line of smoking articles corresponding to each channel set A, B, C lies on the carriage 4 with the smoking articles of each line in side-by-side parallel relation. The carriage 4 reciprocates backwards and forwards so that as it moves backwards, i.e. in the direction indicated by arrow X, the three lines of smoking articles on the carriage 4 are transported rearwardly and laterally away from the channels and are slid or pushed in a longitudinal direction into an adjacent pocket 5 located on a conveyor belt 6 located directly behind each of the channel sets A, B, C in a position 5*a*. Once each of the three lines of smoking articles have been received in a corresponding pocket 5 on the conveyor belt 6, the carriage 4 returns to its original position i.e., it moves forwards in the direction indicated by arrow Y. When the preceding line of smoking articles are moved out from beneath the channels due to movement of the carriage 4 in the direction of arrow X, the smoking articles remaining in the channels drop so that the next line of smoking articles rest on the surface of the carriage 4 and the process is repeated.

The line of smoking articles pushed into the pocket 5 from the first set of channels A forms a first row of the group. Once a line of smoking articles has been received in the pocket 5 located behind the first set of channels A in position 5*a*, the pocket 5 moves, in the direction of arrow Z due to operation of the conveyor belt 6, into a position 5*b* directly behind the second channel set B, so that a line of smoking articles from channel set B can be pushed into the pocket 5, which already contains a first row of smoking articles from channel set A. The line of smoking articles from channel set B lies on top of the first row and forms the second or middle row of the group. The pocket 5 continues to move, in the direction of arrow Z, due to operation of the conveyor belt 6, into a position 5*c* directly behind the third channel set C, so that a line of smoking articles from the third channel set C is pushed into the pocket 5, which already contains both the first and second rows of smoking articles. The line of smoking articles from the third set of channels C lies on top of both the first and second rows to form the third row of the group. Once all three rows have been pushed into the pocket 5, continued movement of the conveyor belt 6 in the direction of arrow Z conveys the group towards a packaging station 7 (only part of which is shown in FIG. 1) which wraps a barrier material around the group to form a bundle before an outer container is formed around the bundle to provide a finished pack of smoking articles. The container may be or comprise a film wrapper in addition to a box or a carton or suchlike.

The carriage 4 has three surfaces 4*a*, 4*b*, 4*c* onto which the smoking articles are deposited from respective channel sets A, B, C. Each surface 4*a*, 4*b*, 4*c* is at a different height that corresponds to the height of the row of smoking articles that the set provides. More specifically, a first surface 4*a* of the carriage 4 associated with the first set of channels A is the lowest, so as to be level with the base of the pockets 5, so that the smoking articles deposited onto the first surface 4*a* from the channel set A are pushed directly onto the base of the pocket 5 on the conveyor belt 6 in response to movement of the carriage 4, a second surface 4*b* associated with the second set of channels B is higher so that it is level with the top of the smoking articles of the first row, and so that the smoking articles deposited onto the second surface 4*b* are pushed into the pocket 5 directly above, and onto, the first row of smoking articles already received in the pocket 5 and, a third surface 4*c* associated with the third set of channels C is higher than the second surface 4*b* so that it is level with the top of the smoking articles of the second row, so that the smoking articles deposited onto the third surface 4*c* are pushed into the pocket 5 directly above and onto the second row of smoking articles already received in the pocket 5.

WO2014/015940 discloses an apparatus and method for forming collations of rod shaped articles such as smoking articles in order to produce a smoking article pack containing plural different types of smoking articles. However, each pack manufactured by the apparatus disclosed by this document is identical, as smoking articles of different types are provided at the same respective predetermined positions in each pack. At least one aspect of the present invention differs from what is disclosed in this document in that it provides a method in which the vast majority of packs will not be identical to each other but will comprise different mixtures of different types of smoking articles.

In particular, a method in accordance with an embodiment of the invention is concerned with forming groups of smoking articles in which the smoking articles of each group comprise a mixture or combination of different types of smoking articles and in which the vast majority of groups will differ from each other in terms of the positioning and number of smoking articles of each type contained within each group. To this end, the method of the invention involves supplying the hopper 2 of the apparatus for forming groups of smoking articles 1, such as the apparatus 1 described above, with two or more different types of smoking articles such as, for example, a mixture of two types of smoking articles (type S1 and S2 in FIG. 2). The hopper 2 may be supplied with a mixture of two or more different types of smoking articles or, smoking articles of different types may be allowed to mix in the hopper 2. Thus, although there does still remain a very small possibility that all the cigarettes of a single group of smoking articles will be of the same type due to the presence of an uncontrolled mixture or assortment of different types of smoking articles in the receptacle, it is highly likely that each group of smoking articles produced by the apparatus 1, which has been supplied with different types of smoking articles according to the method of the invention, will comprise a mixture or combination of the different types of smoking articles supplied to the hopper 2.

It will be appreciated that the different types of smoking articles supplied to the hopper 2 may be random and so it is very unlikely that a particular mixture will be repeated in a subsequent group, at least not for some considerable time during a continuous manufacturing process. Whilst a truly random mixture of different types of smoking articles is possible, mixtures that are not truly random are also intended to be covered by the invention. For example, there may be a pseudorandom mixture of different types of smoking articles in the hopper 2. A truly random combination may not be achievable in practice due to the way in which the smoking articles are manufactured by a smoking article manufacturing machine and supplied to the receptacle of the apparatus for forming the groups of smoking articles.

Whilst at least some mixing of different types of smoking articles may occur prior to supply of the mixture into the receptacle of the apparatus for forming groups of smoking articles, such as, for example, in the smoking article manufacturing machine or during transportation from a smoking article manufacturing machine to the receptacle of the apparatus for forming smoking articles, it is also envisaged that mixing may occur as the smoking articles are fed or supplied into the receptacle of the apparatus for forming groups of smoking articles.

The apparatus 1 produces successive groups of smoking articles on a continuous basis. It will be appreciated that successive groups will comprise different mixtures of different types of smoking article, as a result of supplying the hopper 2 of the apparatus 1 with different types of smoking articles, as each group is formed from the mixture by said apparatus 1.

In a further embodiment, the hopper 2 may comprise multiple sections and each section may feed into a different set of channels or a different number of channels of a set. If, in accordance with one method of the invention, the hopper 2 comprises two sections, one or both of those sections may be supplied with different types of smoking articles and the types of smoking articles supplied to one section may be different to the types of smoking articles supplied to the other section. This means that there is no possibility that all the cigarettes in a single group will be of the same type.

For example, the hopper 2 can be divided into two sections and one of those sections can be supplied with different types of smoking articles and the other section can be supplied with just one type of smoking article of a different type to either of the types of smoking articles of the different types supplied to the first section. Alternatively, the second section can be supplied with different types of smoking articles which are different to the types of smoking articles comprising supplied to the first section.

As different types of smoking articles are supplied to each section and each group is formed from smoking articles that are supplied to both sections, it is impossible for a single group to comprise smoking articles of just one type.

Although the relative number of smoking articles supplied to each group from each section may be fixed, an aspect of the present invention also provides a modified apparatus for forming groups of smoking articles 1, to enable the number of smoking articles that are supplied to each group from the first and second sections of the hopper 2 to be adjusted relative to each other.

Figure 3:
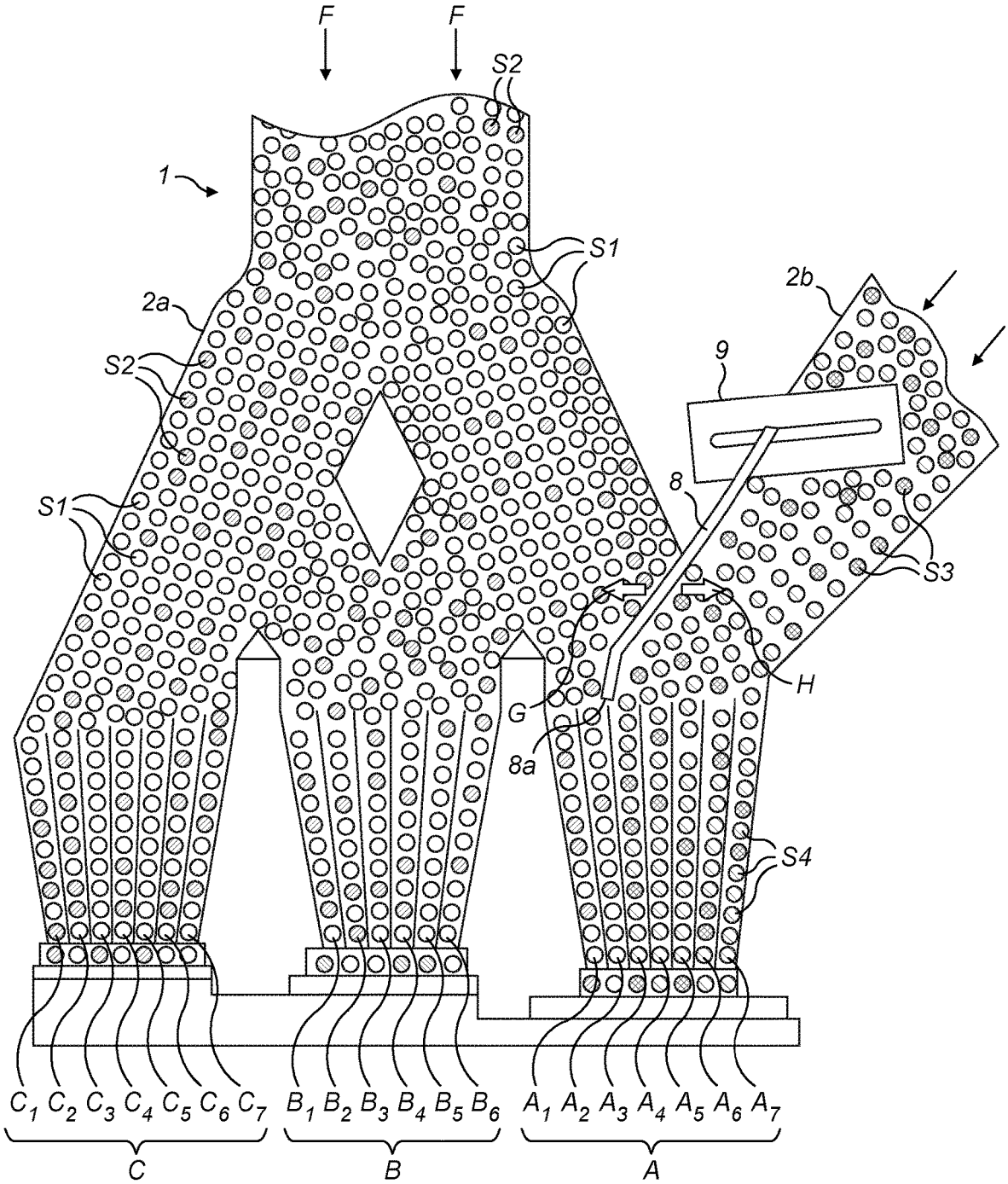
FIG. 3 is a cross-sectional side elevation of a modified apparatus for forming groups of smoking articles, according to the present invention.

FIG. 3 shows a side elevation of a modified version of the apparatus for forming groups of smoking articles as shown in FIG. 1, according to an embodiment of the present invention. Like features will be referred to using the same references. As can be seen in FIG. 3, a movable divider 8 divides the hopper 2 into first and second separate sections 2*a*, 2*b*. Two different types of smoking articles (S1 and S2) are supplied to section 2*a* and a further two different types of smoking articles (S3 and S4) are supplied to section 2*b* of the hopper 2. Consequently, some of the channels are fed with a mixture of smoking articles of types S1 and S2 from the first section 2*a* of the hopper 2 and the remaining channels are fed with a mixture of smoking articles of types S3 and S4 from the second section 2*b* of the hopper 2.

The smoking articles of types S1 and S2 received in a first section 2*a* are fed from the hopper 2 into the channels of each set A, B, C as described above with reference to FIG. 1. However, the dividing element 8 prevents smoking articles of types S1 and S2 in the first section 2*a* from being fed into at least some of the channels of one of the sets. In FIG. 3, the dividing element 8 is positioned relative to the first set of channels A, so as to control the number of smoking articles of types S1 and S2 that are fed into the channels of the first set of channels A. In other embodiments, there can also be a divider positioned relative to at least one of the other channel sets B and C to form additional sections and thereby enable the types smoking articles fed into the channels of sets B and/or C to be controlled.

The divider 8 is a plate extending into the hopper 2. A lowermost edge 8*a* of the plate 8 is positioned just above the ends of the vanes 3 from which the channels of set A are formed. As shown in FIG. 3, the edge 8*a* of the divider 8 is positioned just above the second vane 3 of the first set of channels A so that smoking articles of type S1 and S2 from the first section 2*a* can only pass into two of the channels, A1 and A2, of the first set of channels A1 to A7, because the plate 8 blocks the passage of smoking articles of type S1 and S2 from the first section 2*a* into the remaining channels A3 to A7 of the first set A. Instead, the smoking articles S3 and S4 supplied to the second section 2*b* of the hopper 2 are fed into the remaining channels A3 to A7 of the first set A.

Although it is possible for the divider 8 to be fixed in position, greater flexibility in the type of smoking articles forming the group is provided by mounting the divider 8 to a mechanism 9 which enables it to move, e.g. slide, laterally, either under manual or automatic control, and in response to a signal provided by an operator. As shown in FIG. 3, the divider 8 can slide from side to side, in the directions of arrows G and H, to enable the number of channels of the first set A, which are fed with smoking articles of type S1 and S2 from the first section 2*a* and the number of channels of the first set A which are fed with smoking articles of type S3 and S4 from the second section 2*b*, to be changed, either by an operator or, on an automatic basis. If, for example, the divider 8 is moved to the left as shown in FIG. 3, so that its edge 8*a* is located above the first vane 3 of channel set A, then only one channel, A1, of the first set A will be fed with smoking articles of type S1 and S2 from the first section 2*a*. If the divider 8 is moved all the way to the left, then none of the smoking articles of type S1 and S2 from the first section 2*a* will be fed to the channels of the first set A, and all the channels A1 to A7 of the first set A will be filled with smoking articles of type S3 and S4 from the second section 2*b*. On the other hand, if the divider 8 is moved to the right as shown in FIG. 3, then the number of channels A1 to A7 which can receive smoking articles of type S1 and S2 from the first section 2*a* of the hopper 2 will increase and the number of channels which can receive smoking articles of type S3 and S4 will decrease by a corresponding amount. The number of channels A1 to A7 which will receive smoking articles from the first section 2*a* is dependent on the extent to which the dividing element 8 is moved to the right, i.e. in the direction of arrow H.

It will be appreciated that, by using the apparatus shown in FIG. 3, the first row may comprise a mixture of at least some smoking article types of type S3 and S4, whereas the second and third rows can comprise a mixture of smoking article types S1 and S2 only.

Although it is envisaged that both sections 2*a*, 2*b* will each be supplied with different types of smoking article, it is also envisaged that one section can be supplied with smoking articles of two types (types S1 and S2), and the second section 2*b* can be supplied with smoking articles of only one type (type S3). In this situation, the second and third rows will be made up of a mixture of smoking articles of type S1 and S2, whereas the first row can at least partially be formed from smoking articles of type S3 and from a mixture of smoking articles of type S1 and S2, depending upon the position of the divider 8. Alternatively, the first section can be supplied with smoking articles of just one type (type S1) and the second section can be supplied with smoking articles of two types (types S2 and S3). In this arrangement, the second and third rows will be comprised exclusively from smoking articles of type S1 and the first row can at least partially comprise a mixture of smoking articles of type S2 and S3 in addition to smoking articles of type S1, dependent upon the position of the divider 8.

Although it is envisaged that at least one section 2*a*, 2*b* of the modified apparatus 1 for forming groups of smoking articles with a repositionable divider 8 will be supplied with smoking articles of two different types, it is also considered to be within the scope of the invention for each section 2*a*, 2*b* to be supplied with a single type of smoking article. For example, in a hopper 2 having two sections, the first section 2*a* of the hopper 2 may be supplied with smoking articles of one type (type S1) and the second section 2*b* can be supplied with smoking articles of a second type (type S2). The divider 8 associated with the first set of channels A can then be positioned to ensure that at least some of the smoking articles that form the first row are of type S2, whereas the smoking articles of the second and third rows will all remain of type S1.

Figure 4:
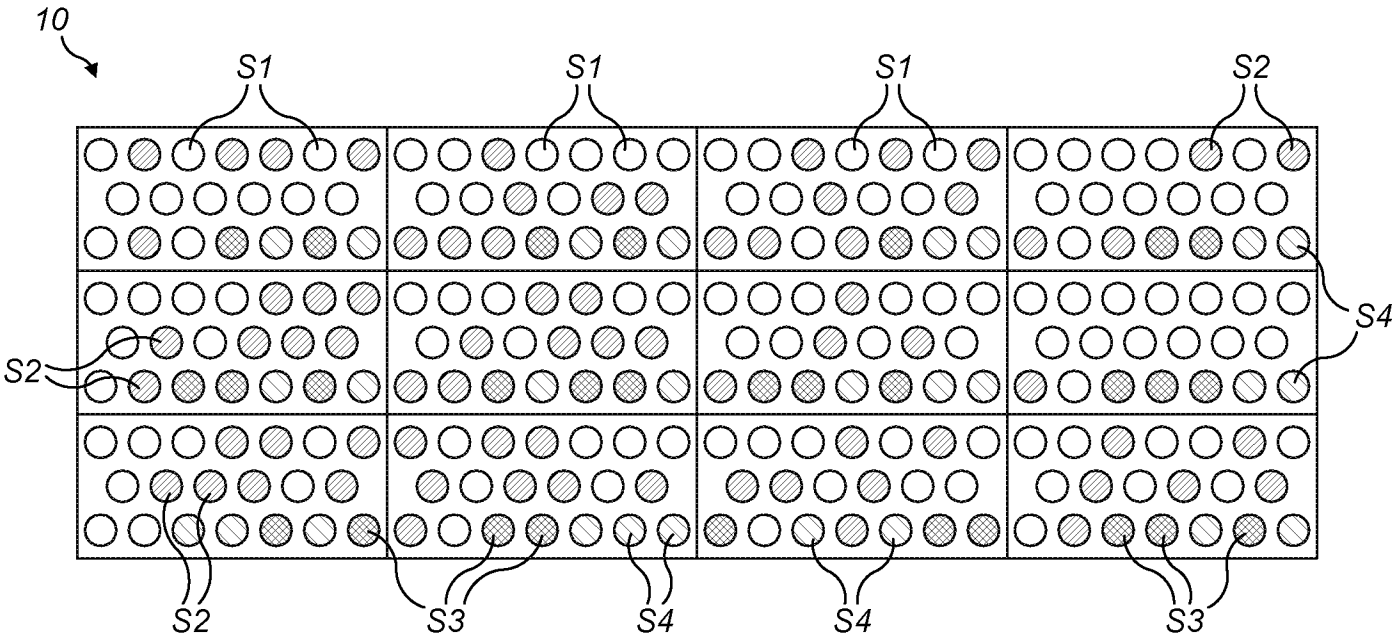
FIG. 4 is a cross-sectional side elevation of a multipack comprising twelve packs of smoking articles formed using the apparatus for forming groups of smoking articles of FIG. 3 and in which each section of the receptacle is supplied with two different types of smoking article.

The smoking article packs manufactured in accordance with the method of the invention and/or using the modified apparatus for forming groups of smoking articles according to the invention may be formed into multipacks, i.e. a pack containing a plurality of individual smoking article packs contained within an outer container. A multipack 10 of twelve smoking article packs, in which the packs have been formed using the apparatus of FIG. 3, with each section of the hopper 2 containing two different types of smoking article, is shown in FIG. 4. As can be seen in FIG. 4, each smoking article pack comprises a group of smoking articles formed from a mixture of two different types of smoking article and the mixture of different types of smoking articles contained in each pack are different to the mixture of different types of smoking articles contained in at least one other of the packs of the multipack.

The different types of smoking articles referred to herein may have filters containing different object types or different combinations of objects. The objects are preferably spherical capsules formed from gelatin each of which has an interior volume filled with flavourant. As used herein, the term "flavourant" refers to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. Capsule types may be differentiated from each other by their content. In particular the capsule contained in the filter of one smoking article type may contain one of the flavourants listed above, whereas the capsule contained in the filter of another type of smoking article may contain a different one of the flavourants listed above.

The capsules may have a diameter of 3.5 mm. It will be appreciated that other objects received in the filters may differentiate the types of smoking article, such as pellets or pieces of charcoal.

The smoking articles may differ in other ways other than by the filter or the objects received within it. For example, different types of smoking article may include different types or blends of tobacco.

Each of the different types of smoking article may be differentiated from each other by visual or tactile means. For example, the tipping paper which is wrapped about the filter element of each smoking article may be marked differently or have a different embossing on it to provide an indication to a consumer as to its particular type. The colouring, marking or tactile feel of a smoking article may be such that it would be identifiable by a consumer as being of a particular type.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A method of forming groups of smoking articles so that each group forms an individual bundle of smoking articles for receipt in a respective smoking article pack, wherein the method comprises supplying a receptacle of an apparatus for forming groups of smoking articles with different types of smoking articles such that they mix in the receptacle and each group is formed from the mixture of different types of smoking articles by said apparatus, wherein the receptacle comprises a divider to separate the receptacle into a first section and a second section, and the method comprises supplying different types of smoking articles to the first section and supplying smoking articles to the second section, the smoking articles being supplied to the second section being of a different type to the types of smoking articles being supplied to the first section, the apparatus being configured so that each group formed by said apparatus includes smoking articles from both the first section and the second section.

2. A method according to claim 1, comprising supplying the receptacle with a mixture of different types of smoking articles.

3. The method according to claim 2, wherein the supplying of different types of smoking article to the first section comprises supplying them to the first section so that they mix in the first section.

4. The method according to claim 2, wherein the method comprises supplying the second section of the receptacle with smoking articles only of a single type.

5. The method according to claim 3, wherein the method comprises supplying the second section of the receptacle with different types of smoking articles.

6. A method according to claim 5, wherein the supplying of different types of smoking article to the second section comprises supplying them to the second section so that they mix in the second section.

7. The method according to claim 1, wherein the method comprises positioning the divider to control the relative number of smoking articles supplied from each section.

8. The method according to claim 5, wherein the apparatus comprises a set of channels arranged so that smoking articles fed from the receptacle travel downwardly along each channel in single file, the number of channels corresponding to the number of smoking articles in a row that forms a portion of a group of smoking articles, the arrangement being such that smoking articles at a lowermost end of the channels are pushed into a pocket to form a row that makes up a portion of a group of smoking articles, wherein the method comprises positioning the divider so that some of the channels are fed with smoking articles from the first section and some of the channels are fed with smoking articles from the second section, such that the row of smoking articles comprises a mixture of smoking articles from both the first and second sections.

9. A multipack comprising a plurality of smoking article packs contained within an outer container, each of the smoking article packs comprising a group of smoking articles formed from a mixture of at least two different types of smoking articles, wherein the mixture of different types of smoking articles contained in one of the packs differs from the mixture of different types of smoking articles contained in at least one other of the packs.

10. The multipack according to claim 9, wherein each type of smoking article has a different respective appearance to enable smoking articles of each type to be visually distinguished from smoking articles of each of the other types.

11. The multipack according to claim 9, wherein each type of smoking article includes tipping paper and each type of smoking article has a correspondingly different type of tipping paper.

* * * * *